US008057650B2

(12) United States Patent
Hayashi et al.

(10) Patent No.: US 8,057,650 B2
(45) **Date of Patent: *Nov. 15, 2011**

(54) SOFT MAGNETIC FECO BASED TARGET MATERIAL

(75) Inventors: Ryoji Hayashi, Himeji (JP); Akihiko Yanagitani, Himeji (JP); Yoshikazu Aikawa, Himeji (JP); Toshiyuki Sawada, Himeji (JP)

(73) Assignee: Sanyo Special Steel Co., Ltd., Hyogo-Ken (JP)

( * ) Notice: Subject to any disclaimer, the term of this patent is extended or adjusted under 35 U.S.C. 154(b) by 138 days.

This patent is subject to a terminal disclaimer.

(21) Appl. No.: 11/983,208

(22) Filed: Nov. 7, 2007

(65) Prior Publication Data

US 2008/0112841 A1 May 15, 2008

(30) Foreign Application Priority Data

Nov. 13, 2006 (JP) ..... 2006-306881

(51) Int. Cl.
*C25B 11/04* (2006.01)

(52) U.S. Cl. ..... 204/298.13; 148/311; 148/313; 420/103; 420/104; 420/122; 420/123; 420/124; 420/125; 420/126; 420/127

(58) Field of Classification Search ..... None
See application file for complete search history.

(56) References Cited

U.S. PATENT DOCUMENTS

| | | | | |
|---|---|---|---|---|
| 4,992,095 | A | 2/1991 | Nate et al. | |
| 5,587,026 | A * | 12/1996 | Iwasaki et al. | 148/313 |
| 5,780,175 | A | 7/1998 | Chen et al. | |
| 6,033,536 | A | 3/2000 | Ichihara et al. | |
| 6,632,520 | B1 * | 10/2003 | Hiramoto et al. | 428/336 |
| 6,828,046 | B2 * | 12/2004 | Ikeda et al. | 428/812 |
| 7,141,208 | B2 | 11/2006 | Ueno et al. | |
| 7,294,418 | B2 * | 11/2007 | Ikeda et al. | 428/816 |
| 2002/0058159 | A1 | 5/2002 | Kubota et al. | |
| 2006/0042938 | A1 | 3/2006 | Cheng et al. | |
| 2006/0199044 | A1 | 9/2006 | Thangaraj et al. | |
| 2007/0017803 | A1 | 1/2007 | Ziani et al. | |
| 2007/0251821 | A1 * | 11/2007 | Yanagitani et al. | 204/298.13 |
| 2008/0038145 | A1 * | 2/2008 | Yanagitani et al. | 420/125 |
| 2008/0063555 | A1 | 3/2008 | Sawada et al. | |
| 2008/0083616 | A1 * | 4/2008 | Fukuoka et al. | 204/298.13 |
| 2008/0112841 | A1 | 5/2008 | Hayashi et al. | |
| 2008/0138235 | A1 * | 6/2008 | Sawada et al. | 420/125 |

FOREIGN PATENT DOCUMENTS

| | | | |
|---|---|---|---|
| JP | 4-325670 | A | 11/1892 |
| JP | 62040363 | A | 2/1987 |
| JP | 6035654 | B2 | 5/1994 |
| JP | 2004346423 | A | 12/2004 |
| JP | 2005320627 | A | 11/2005 |
| JP | 2007284741 | A | 11/2007 |

OTHER PUBLICATIONS

Hansen, Constitution of Binary Alloys, McGraw-Hill Book Company, 1958, pp. 471 to 474.*

* cited by examiner

*Primary Examiner* — John Sheehan
(74) *Attorney, Agent, or Firm* — The Webb Law Firm

(57) ABSTRACT

A soft-magnetic FeCo based target material is provided which has a high saturation magnetic flux density and superior atmospheric corrosion resistance. The target material is a soft-magnetic FeCo based target material made of an FeCo based alloy. The FeCo based alloy comprises 0 to 30 at. % of one or more metal elements selected from the group consisting of B, Nb, Zr, Ta, Hf, Ti and V; and the balance being Fe and Co with unavoidable impurities. The Fe:Co atomic ratio ranges from 10:90 to 70:30. The FeCo based alloy may further comprise 0.2 at. % to 5.0 at. % of Al and/or Cr.

3 Claims, No Drawings

SOFT MAGNETIC FECO BASED TARGET MATERIAL

CROSS-REFERENCE TO RELATED APPLICATION

The present application claims priority to Japanese Patent Application No. 2006-306881 filed on Nov. 13, 2006, the entire disclosure of which is incorporated herein by reference.

BACKGROUND OF THE INVENTION

1. Field of the Invention

The present invention relates to soft-magnetic FeCo based target materials which have superior atmospheric corrosion resistance and magnetic properties.

2. Description of Related Art

In recent years, there have been remarkable progresses in magnetic recording technology, and heightening record densities in magnetic record media is proceeding due to increasing drive capacities. In magnetic record media for longitudinal magnetic recording systems currently used worldwide, however, attempts to realize high record densities result in refined record bits, which require high coercivity to such an extent that recording cannot be conducted with the record bits. In view of this, a perpendicular magnetic recording system is being studied as a means for solving these problems and improving record density.

The perpendicular magnetic recording system is a system in which a magnetization-easy axis is oriented in the direction vertical to a medium surface in the magnetic film of a perpendicular magnetic record medium, and is suitable for high record densities. In addition, as for the perpendicular magnetic recording system, a two-layered record medium has been developed having a magnetic record film where record sensitivity is improved and a soft-magnetic film. CoCrPt—$SiO_2$ alloys are generally used for this magnetic record film.

Examples of known soft-magnetic layers are as follows. Japanese Patent Laid-Open Publication No. 2004-346423 proposes an Fe—Co—B alloy target material in which the diameter of the maximum inscribed circle which can be drawn in a region with no boride phase in a cross-microstructure is equal to 30 μm or less. Japanese Patent Laid-Open Publication No. 2005-320627 proposes a CoZrNb and/or CoZrTa alloy target material which restricts variations of soft-magnetic films formed by sputtering and achieves a reduction in particles produced in the sputtering process.

It is known that FeCo based alloys comprising Fe and about 35 at. % Co have the highest saturation magnetic flux density. For example, U.S. Patent application Publication No. 2002/0058159 proposes a soft-magnetic film made of a boron (B)-doped alloy comprising Fe and 35 at. % Co.

Magnetron sputtering methods are generally used for preparation of the aforementioned soft magnetic films. This magnetron sputtering method is a method in which a magnet is disposed behind a target material to leak the magnetic flux onto a surface of the target material for converging plasma in the leaked magnetic flux region, thus enabling a high-speed coating. Fe-based materials are desired since high magnetic flux density is required for a soft-magnetic film made of a target material used for the magnetron sputtering. In this case, however, there are problems that corrosion resistance is unsatisfactory, that oxidation of the target material degrades film quality, and that abnormal discharges occur in the oxidized area during the sputtering process to result in sputtering failure.

SUMMARY OF THE INVENTION

The inventors have now found that atmospheric corrosion resistance can be improved in FeCo based target materials without impairing superior magnetic properties, such as high saturation magnetic flux density, by adopting an Fe:Co atomic ratio in the range of 10:90 and 70:30.

Accordingly, the purpose of the present invention is to provide a soft-magnetic FeCo based target material which has a high saturation magnetic flux density and superior atmospheric corrosion resistance.

The present invention provides a soft-magnetic FeCo based target material made of an FeCo based alloy, the FeCo based alloy comprising:

0 to 30 at. % of one or more metal elements selected from the group consisting of B, Nb, Zr, Ta, Hf, Ti and V; and the balance being Fe and Co with unavoidable impurities, wherein the FeCo based alloy has an Fe:Co atomic ratio in the range of 10:90 to 70:30.

DETAILED DESCRIPTION OF THE INVENTION

Soft-Magnetic FeCo Based Target Material

The present invention relates to a soft-magnetic FeCo based target material made of an FeCo based alloy. The FeCo based alloy used in the present invention comprises 0 to 30 at. % of one or more metal elements selected from the group consisting of B, Nb, Zr, Ta, Hf, Ti and V, the balance being Fe and Co with unavoidable impurities. The Fe:Co atomic ratio ranges from 10:90 to 70:30.

The target material of the present invention is made of an FeCo based alloy mainly comprising Fe and Co. The FeCo based alloy is preferably used for perpendicular magnetic recording media, as an alloy having a high saturation magnetic flux density.

The FeCo based alloy used in the present invention comprises Fe and Co as the main constituent elements which form the balance of the FeCo based alloy. The Fe:Co atomic ratio ranges from 10:90 to 70:30, preferably from 15:85 to 55:45, and more preferably from 25:75 to 45:55. Within these ranges, it is possible to improve atmospheric corrosion resistance without impairing superior magnetic properties such as high saturation magnetic flux density.

According to a preferred aspect of the present invention, the FeCo based alloy may comprise 0.2 to 5.0 at. %, preferably 0.5 to 3.0 at. %, of Al and/or Cr. Within these ranges, it is possible to further improve the atmospheric corrosion resistance while reducing deterioration of the magnetic properties sufficiently.

According to a preferred aspect of the present invention, the FeCo based alloy can comprise 30 at. % or less, preferably 5 to 20 at. %, of one or more metal elements selected from the group consisting of B, Nb, Zr, Ta, Hf, Ti and V. These elements, B, Nb, Zr, Ta, Hf, Ti and V are elements for accelerating amorphous formation of thin films, while a total amount of these additive elements exceeding 30 at. % deteriorates the magnetic properties.

Producing Method

Regarding a method for producing the FeCo based alloy of the present invention, vacuum melting and casting are typically employed. However, vacuum melting and casting the FeCo based alloy results in crystal orientation depending on the direction of solidification, thus making it difficult to achieve uniform cast structure in terms of chemical composition. For this reason, in melted and cast Co alloy target materials, a difference in sputter rate depending on the crystal orientation is caused and the leakage magnetic flux in the magnetron sputtering process varies, resulting in variations in the sputtered soft-magnetic film. In view of this, the inventors have studied various methods for producing the FeCo based alloy target material, and eventually found that a uniform target material in terms of crystal orientation as well as of chemical composition can be achieved by powder metallurgy process.

The consolidating method employed in the present invention includes any techniques that can consolidate a high density target material, such as HIP, hot pressing technique, and the like. The method for producing the powder includes any techniques, such as gas atomizing, water atomizing and casting-crushing, but is not limited to these. As described above, the magnetron sputtering technique is typically used for producing soft-magnetic films.

EXAMPLES

The present invention will be described below in detail with reference to examples.

As shown in Table 1, FeCo based alloys were produced by a gas atomizing technique or a casting technique. The conditions for the gas atomizing were that an argon gas was used, the diameter of a nozzle was 6 mm and a gas pressure was 5 MPa. In the casting technique, a raw material was melted by using a ceramic crucible (ϕ200×30 L), and then crushed into powder. Then, the particle size of the powder thus produced was classified to obtain powder with particle sizes of 500 μm or less. Then, the obtained powder was mixed for one hour by a V-type mixer.

The powder thus produced was charged into a sealed container made of a machine structural carbon steel and having a diameter of 200 mm and a height of 100 mm. Then, the sealed container was evaculated and vacuum-sealed at an ultimate pressure of $10^{-1}$ Pa or less. Then, HIP (Hot Isostatic Pressing) was performed to produce an ingot on condition that the temperature was 1373 K, the pressure was 150 MPa and the retention time was five hours. Then, the ingot thus produced was subjected to a machining process to obtain target materials each having a final configuration with an outer diameter of 180 mm and a thickness of 3 mm to 10 mm. The properties of the target materials are shown in Table 1.

TABLE 1

| | Target Material Composition (at %) | | | | | | | | | | |
|---|---|---|---|---|---|---|---|---|---|---|---|
| No | Fe:Co (at % ratio) | Al | Cr | B | Nb | Zr | Ta | Hf | Ti | V | |
| 1 | 10:90 | — | — | — | — | — | — | — | — | — | Examples |
| 2 | 40:60 | — | — | — | — | — | — | — | — | — | |
| 3 | 70:30 | — | — | — | — | — | — | — | — | — | |
| 4 | 10:90 | 0.2 | — | — | — | — | — | — | — | — | |
| 5 | 40:60 | — | 5 | — | — | — | — | — | — | — | |
| 6 | 60:40 | 1 | 1 | — | — | — | — | — | — | — | |
| 7 | 70:30 | — | — | 10 | — | — | — | — | — | — | |
| 8 | 10:90 | — | — | — | 5 | 5 | — | — | — | — | |
| 9 | 40:60 | — | — | — | — | — | 3 | 4 | — | — | |
| 10 | 40:60 | — | — | — | — | — | — | — | 10 | — | |
| 11 | 60:40 | — | — | — | — | — | — | — | — | 10 | |
| 12 | 60:40 | — | — | — | — | 4 | — | — | 8 | — | |
| 13 | 40:60 | 5 | — | 20 | — | — | — | — | — | — | |
| 14 | 10:90 | — | 0.2 | — | 3 | — | — | 6 | — | — | |
| 15 | 70:30 | 3 | — | — | — | 3 | 8 | — | — | — | |
| 16 | 60:40 | 2 | 2 | — | — | — | — | — | — | 5 | |
| 17 | 40:60 | — | — | — | — | — | — | — | — | — | |
| 18 | 10:90 | — | — | — | 5 | 5 | — | — | — | — | |
| 19 | 60:40 | 2 | 2 | — | — | — | — | — | — | 5 | |
| 20 | 5:95 | — | — | 15 | — | — | — | — | — | — | Comp. |
| 21 | 80:20 | — | — | — | — | — | — | — | — | — | Example |
| 22 | 10:90 | — | 8 | — | — | 4 | 5 | — | — | — | |
| 23 | 40:60 | 0.1 | — | 10 | — | — | — | — | — | — | |
| 24 | 60:40 | — | — | — | 10 | — | — | 25 | — | — | |
| 25 | 40:60 | — | — | — | — | — | — | — | 32 | — | |

(Underlines indicate failure to meet the claimed conditions)

TABLE 2

| | | Evaluation Results | | |
|---|---|---|---|---|
| No | Producing Method | Saturation magnetic flux density (T) | Atmospheric corrosion resistance | |
| 1 | Powder | 1.95 | Good | Invention |
| 2 | Powder | 2.35 | Good | Example |
| 3 | Powder | 2.47 | Good | |
| 4 | Powder | 1.92 | Good | |
| 5 | Powder | 2.28 | Good | |
| 6 | Powder | 2.43 | Good | |
| 7 | Powder | 1.57 | Good | |
| 8 | Powder | 1.52 | Good | |
| 9 | Powder | 1.72 | Good | |
| 10 | Powder | 1.64 | Good | |
| 11 | Powder | 1.68 | Good | |
| 12 | Powder | 1.57 | Good | |
| 13 | Powder | 1.83 | Good | |
| 14 | Powder | 1.57 | Good | |
| 15 | Powder | 1.61 | Good | |
| 16 | Powder | 1.91 | Good | |
| 17 | Casting | 2.33 | Good | |
| 18 | Casting | 1,54 | Good | |
| 19 | Casting | 1.89 | Good | |
| 20 | Powder | 1.03 | Good | Comparative |
| 21 | Powder | 2.29 | Not Good | example |
| 22 | Powder | 1.22 | Good | |
| 23 | Powder | 2.03 | Not Good | |
| 24 | Powder | 1.09 | Good | |
| 25 | powder | 0.87 | Good | |

For evaluation items of the properties of the target materials thus produced, the atmospheric corrosion resistance test (accelerated test) and the measurement of the magnetic properties (saturation magnetic flux density) were conducted as described below.

(1) Atmospheric Corrosion Resistance Test (Accelerated Test)

A salt spray test was carried out on the target materials in accordance with JIS Z 2371. A 5 mass % NaCl solution was sprayed on the target materials at 35° C. for 24 hours. Then, visual observations were made on the appearance of the target materials to evaluate the presence/absence of rust. The following is used for the evaluations.

Good: without rust

Not Good: with rust (2) Magnetic Properties (Saturation Magnetic Flux Density)

Ring specimens each having an outer diameter of 15 mm, an inner diameter of 10 mm, and a height of 5 mm were made, Then, a B-H tracer was used to measure the saturation magnetic flux density of each ring specimen in an applied magnetic field of 8 kA/m.

As shown Table 1, Nos. 1 to 19 are working examples, while Nos. 20 to 25 are comparative examples. Comparative example No. 20 has a low Fe content and a high Co content, resulting in a low saturation magnetic flux of the magnetic properties. Comparative example No. 21 has a high Fe content and a low Co content, resulting in poor atmospheric corrosion resistance. Comparative example No. 22 has a low saturation magnetic flux density because of the high amount of Cr. Comparative example No. 23 has poor atmospheric corrosion resistance because of the low amount of Al. Comparative example No. 24 has a low saturation magnetic flux density because of the high total amount of Nb and Hf. Comparative example No. 25 has a low saturation magnetic flux density because of the high Ti content.

As described above, controlling the atomic ratio of Fe to Co to an Fe:Co range from 10:90 to 70:30 makes it possible to produce a soft-magnetic FeCo based target material having a high saturation magnetic flux density and improved atmospheric corrosion resistance. This enables to achieve significantly beneficial effects of providing sufficient atmospheric corrosion resistance in environmental conditions in which a device incorporating electron components is used in a room.

What is claimed is:

1. A soft-magnetic FeCo based target material made of an FeCo based alloy, the FeCo based alloy consisting of:

0 to 30 at. % of one or more metal elements selected from the group consisting of Nb, Zr, Ta, Hf, Ti and V;

0.2 to 5.0 at. % of one or more metal elements selected from the group consisting of Al and Cr; and the balance being Fe and Co with unavoidable impurities, wherein the FeCo based alloy has an Fe:Co atomic ratio in the range of 40:60 to 70:30.

2. A soft-magnetic FeCo based target material made of an FeCo based alloy, the FeCo based alloy consisting of:

5 to 30 at. % of one or more metal elements selected from the group consisting of Nb, Zr, Ta, Hf, Ti and V;

0 to 5.0 at. % of one or more metal elements selected from the group consisting of Al and Cr; and the balance being Fe and Co with unavoidable impurities, wherein the FeCo based alloy has an Fe:Co atomic ratio in the range of 40:60 to 70:30.

3. The target material according to claim 1, wherein the one or more metal elements selected from the group consisting of Nb, Zr, Ta, Hf, Ti and V are present in an amount of 5 to 30 at. %.

* * * * *